US007065439B2

(12) United States Patent
Sakakura

(10) Patent No.: US 7,065,439 B2
(45) Date of Patent: Jun. 20, 2006

(54) VEHICLE DOOR LOCKING AND UNLOCKING SYSTEM

(75) Inventor: Hiroaki Sakakura, Tokyo (JP)

(73) Assignee: Alpha Corporation, Kanagawa (JP)

( * ) Notice: Subject to any disclaimer, the term of this patent is extended or adjusted under 35 U.S.C. 154(b) by 0 days.

(21) Appl. No.: 10/662,336

(22) Filed: Sep. 16, 2003

(65) Prior Publication Data

US 2004/0059483 A1 Mar. 25, 2004

(30) Foreign Application Priority Data

Sep. 19, 2002 (JP) ..... P2002-273675

(51) Int. Cl.
*E05B 65/20* (2006.01)

(52) U.S. Cl. ..... 701/49; 340/426.36

(58) Field of Classification Search ..... 701/36, 701/49; 307/10.2; 340/426.17, 426.13, 340/426.36, 5.2, 5.61, 5.62, 5.63
See application file for complete search history.

(56) References Cited

U.S. PATENT DOCUMENTS

| | | | | |
|---|---|---|---|---|
| 5,744,875 | A | 4/1998 | Kleefeldt et al. | |
| 5,790,043 | A | 8/1998 | Hettich et al. | |
| 5,898,365 | A | 4/1999 | Niederlein | |
| 6,034,617 | A * | 3/2000 | Luebke et al. | 340/5.62 |
| 6,247,343 | B1 * | 6/2001 | Weiss et al. | 70/277 |
| 6,290,269 | B1 * | 9/2001 | Bodley-Scott et al. | 292/216 |
| 6,577,228 | B1 * | 6/2003 | Tsuchida et al. | 340/5.72 |
| 6,703,919 | B1 * | 3/2004 | Baset | 340/5.72 |
| 6,724,322 | B1 * | 4/2004 | Tang et al. | 340/989 |
| 6,798,336 | B1 * | 9/2004 | Kanda et al. | 340/5.61 |
| 6,809,630 | B1 * | 10/2004 | Dreimann et al. | 340/5.62 |
| 6,819,229 | B1 * | 11/2004 | Ghabra et al. | 340/426.36 |
| 2003/0095416 | A1 * | 5/2003 | Huizenga | 362/501 |
| 2004/0075531 | A1 * | 4/2004 | Ieda et al. | 340/5.72 |

FOREIGN PATENT DOCUMENTS

| | | | |
|---|---|---|---|
| FR | 2724613 | * | 3/1996 |
| JP | P2002-030844 | | 1/2002 |
| JP | P2002-030845 | | 1/2002 |
| JP | 2002-295062 | * | 10/2002 |
| WO | 96/22439 | | 4/1999 |

* cited by examiner

*Primary Examiner*—Michael J. Zanelli
(74) *Attorney, Agent, or Firm*—Nath & Associates PLLC; Gregory B. Kang; Teresa M. Arroyo

(57) ABSTRACT

An indicator (5) is provided, which displays that it is a locking confirmable period, for predetermined time after locking the door, in a vehicle door locking and unlocking system S, which locks or unlocks the vehicle door by performing communication between a controller (6), which controls locking or unlocking of the vehicle door, and a portable machine (7).

4 Claims, 4 Drawing Sheets

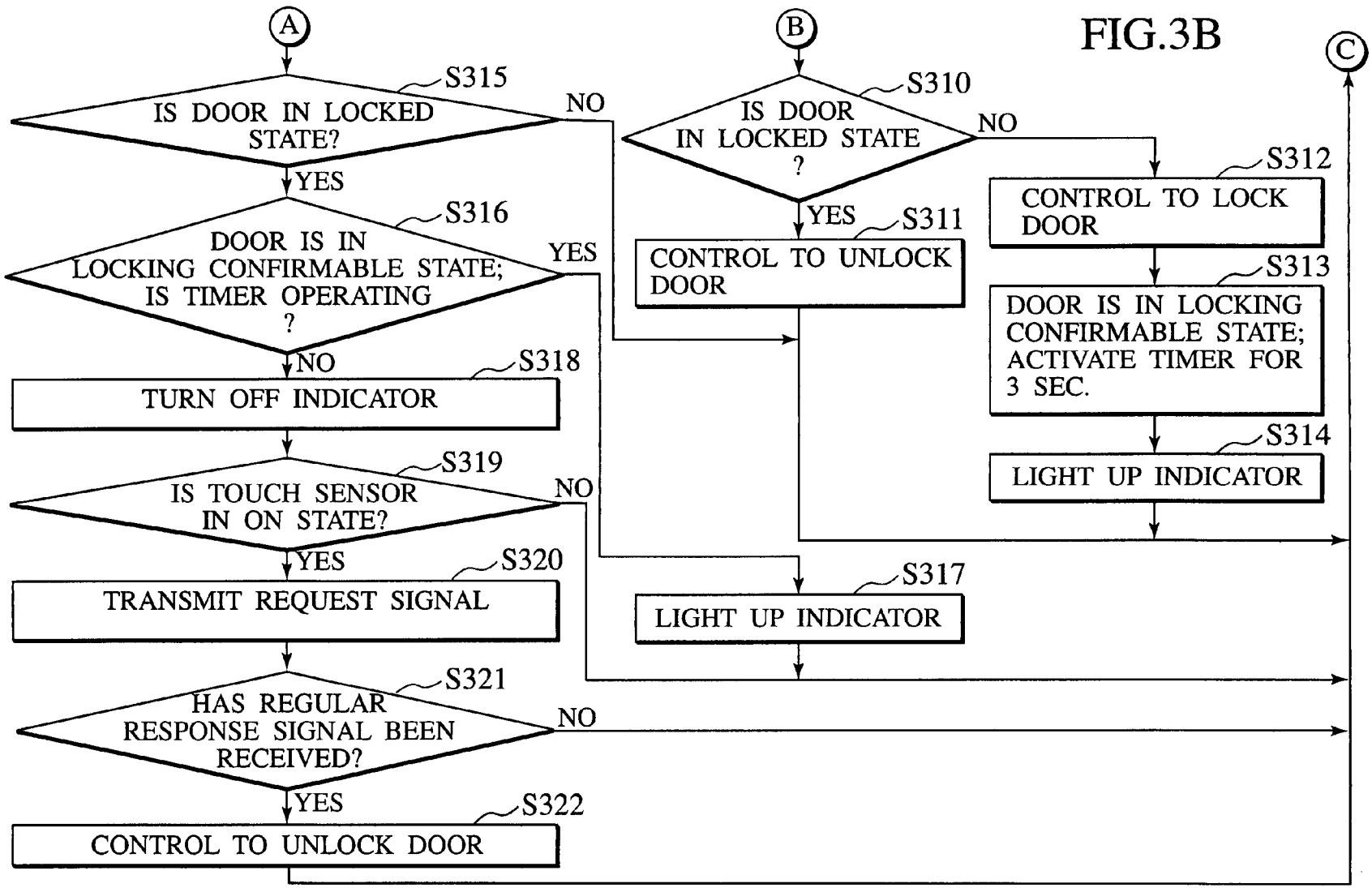
FIG.3B
A
B
C
S310
IS DOOR IN LOCKED STATE ?
NO
YES
S311
CONTROL TO UNLOCK DOOR
S312
CONTROL TO LOCK DOOR
S313
DOOR IS IN LOCKING CONFIRMABLE STATE; ACTIVATE TIMER FOR 3 SEC.
S314
LIGHT UP INDICATOR
S315
IS DOOR IN LOCKED STATE?
NO
YES
S316
DOOR IS IN LOCKING CONFIRMABLE STATE; IS TIMER OPERATING ?
YES
NO
S317
LIGHT UP INDICATOR
S318
TURN OFF INDICATOR
S319
IS TOUCH SENSOR IN ON STATE?
NO
YES
S320
TRANSMIT REQUEST SIGNAL
S321
HAS REGULAR RESPONSE SIGNAL BEEN RECEIVED?
NO
YES
S322
CONTROL TO UNLOCK DOOR

VEHICLE DOOR LOCKING AND UNLOCKING SYSTEM

CROSS REFERENCE TO RELATED APPLICATIONS

This application is based upon and claims the benefit of priority from the prior Japanese Patent Applications No. P2002-273675, filed on Sep. 19, 2002; the entire contents of which are incorporated herein by reference.

BACKGROUND OF THE INVENTION

1. Field of the Invention

The present invention relates to a vehicle door locking and unlocking system, which locks and unlocks a vehicle door by remote operation using a remote controller or the like, and more specifically, relates to a vehicle door locking and unlocking system, in which locking confirmable period is provided after locking.

2. Description of the Related Art

In a conventional vehicle door locking and unlocking system, there is known a so-called smart entry system, wherein communication is performed between a portable machine (a remote controller) which transmits a door locking or unlocking signal and a receiver (controller) provided in a vehicle, and locking or unlocking of a door is performed without using a door key (e.g., see Japanese Patent Application Laid-Open No. 2002-30845).

In the smart entry system, when a user with the portable machine operates a door handle at the time of getting on a car, a touch sensor provided in the door handle detects the operation, and a request signal is transmitted from an in-vehicle apparatus to the portable machine. When the portable machine has received the request signal, the portable machine transmits a response signal including information of an ID code indicating that the user is the proper user to the vehicle, and the door is unlocked upon confirmation of the ID code. On the other hand, when the user operates, for example, a request switch installed in the vicinity of the door handle, communication is performed as described above between the vehicle and the portable machine, and the door is locked upon confirmation of the ID code.

FIG. 6 of Japanese Patent Application Laid-Open No. 2002-30845 illustrates a conventional example of a portable machine, and a transmission section and a transmission antenna provided on a vehicle for communicating with the portable machine.

FIG. 3 of Japanese Patent Application Laid-Open No. 2002-30844 illustrates a conventional example of a touch sensor for detecting that the door handle is operated.

In the conventional smart entry system, after having locked the door by using the system, the user may confirm that the door has been locked securely by operating the door handle. If this locking confirmation action is performed immediately after the door has been locked by using the system, the touch sensor detects the operation of the door handle. Therefore, communication is performed between the vehicle and the portable machine, and upon confirmation of the ID, the door is unlocked. In other words, the door is unlocked again, resulting from the user's locking confirmation action. This is because the system judges that the user's locking confirmation action as the unlocking operation.

To dissolve such a problem, there is a method in which after locking the door by the system, locking confirmable predetermined time (hereinafter, referred to as a "locking confirmable period") for permitting user's locking confirmation action is provided. Specifically, for a predetermined period after locking the door, for example, for a period of several seconds, the detection operation of the touch sensor is made invalid. In other words, even if the user operates the door handle for confirming locking of the door in the locking confirmable period after locking the door, the touch sensor does not detect the operation of the door, to avoid unlocking of the door.

As described above, in the conventional smart entry system, the locking confirmable period has been set, during which even if the user operates the door handle to confirm locking after locking the door, the door is not unlocked.

However, it is difficult for the user to recognize the actual locking confirmable period, at the time of confirming locking of the door, though the user understands the locking confirmable period. For example, when the user does not perform the locking confirmation action, and tries to perform the locking confirmation action after some time has passed, it is difficult to judge whether it is within the locking confirmable period.

Therefore, after the locking confirmable period has passed after locking the door, if the user operates the door handle for confirming locking condition of the door, without noticing that the locking confirmable period has already passed, the door is unlocked. Hence, it is necessary to inform the user of the locking confirmable period.

In view of the above situation, it is an object of the present invention to provide a vehicle door locking and unlocking system that informs the user of the locking confirmable period.

SUMMARY OF THE INVENTION

In order to achieve the object, a vehicle door locking and unlocking system of the present invention comprises: a controller mounted on a vehicle, which transfers a predetermined frequency to control locking and unlocking of a door of the vehicle door; a portable machine which uses the same frequency as the predetermined frequency to transmit a door locking or unlocking instruction to the controller; and a display provided in the vehicle and controlled by the controller, wherein the controller allows the display to display that it is a locking confirmable period for predetermined time since detecting locking of the door.

BRIEF DESCRIPTION OF THE DRAWINGS

FIGS. 3A and 3B are flowcharts of a procedure in locking and unlocking processing in the vehicle door locking and unlocking system.

DETAILED DESCRIPTION OF THE INVENTION

One embodiment of the present invention will be described, with reference to the drawings.

Figure 1:
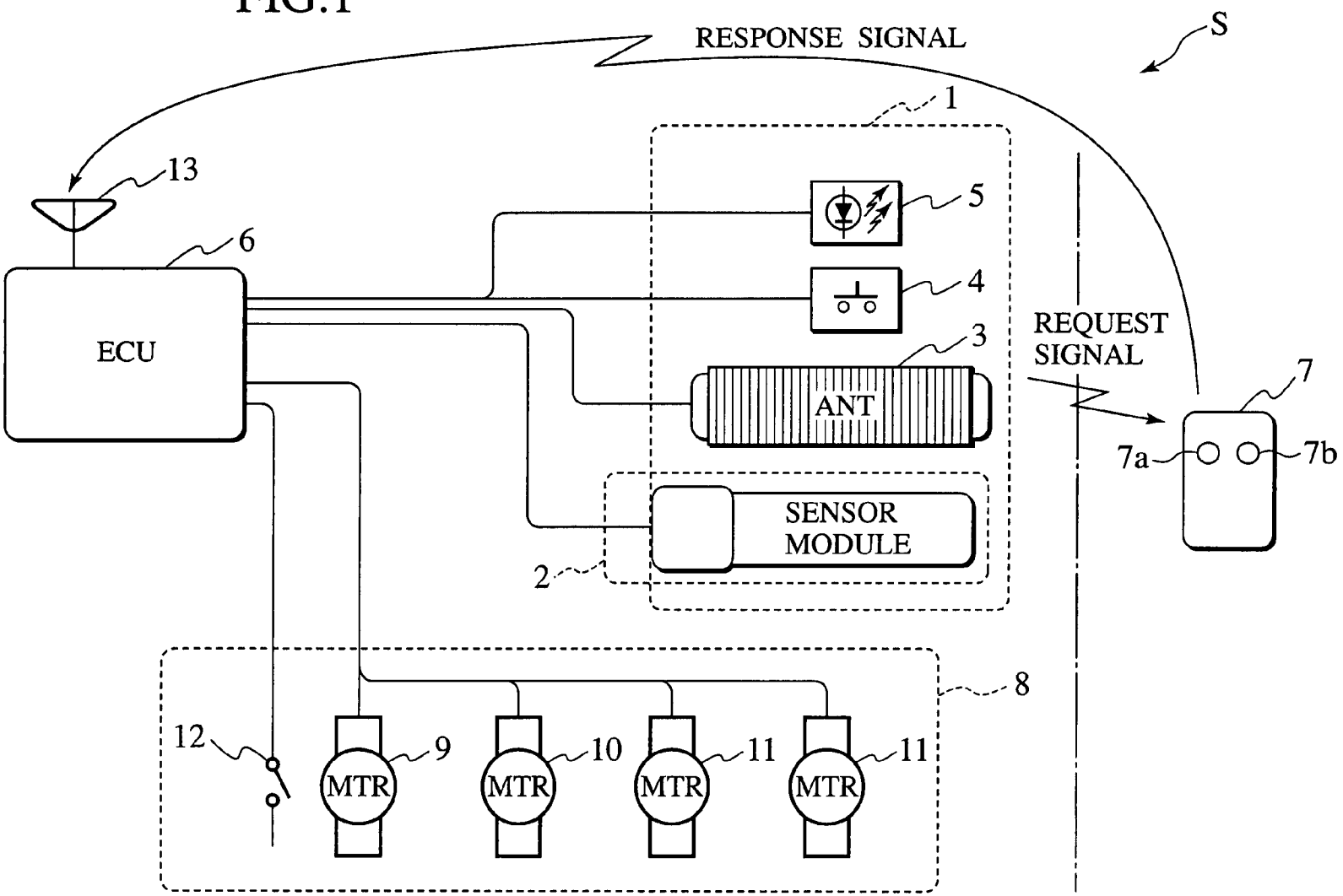
FIG. 1 illustrates the configuration of a vehicle door locking and unlocking system according to one embodiment of the present invention.

As shown in FIG. 1, a vehicle door locking and unlocking system S in this embodiment comprises a touch sensor 2, an antenna 3, a request switch 4, an indicator 5 and an ECU (electric controller) 6 for performing overall control of the system S including the control of locking and unlocking of the door, which are provided in a door handle 1, and a portable machine 7 which is held by a user who drives the vehicle. The portable machine 7 may be provided with an unlocking button 7*a* and a locking button 7*b*.

Figure 2:
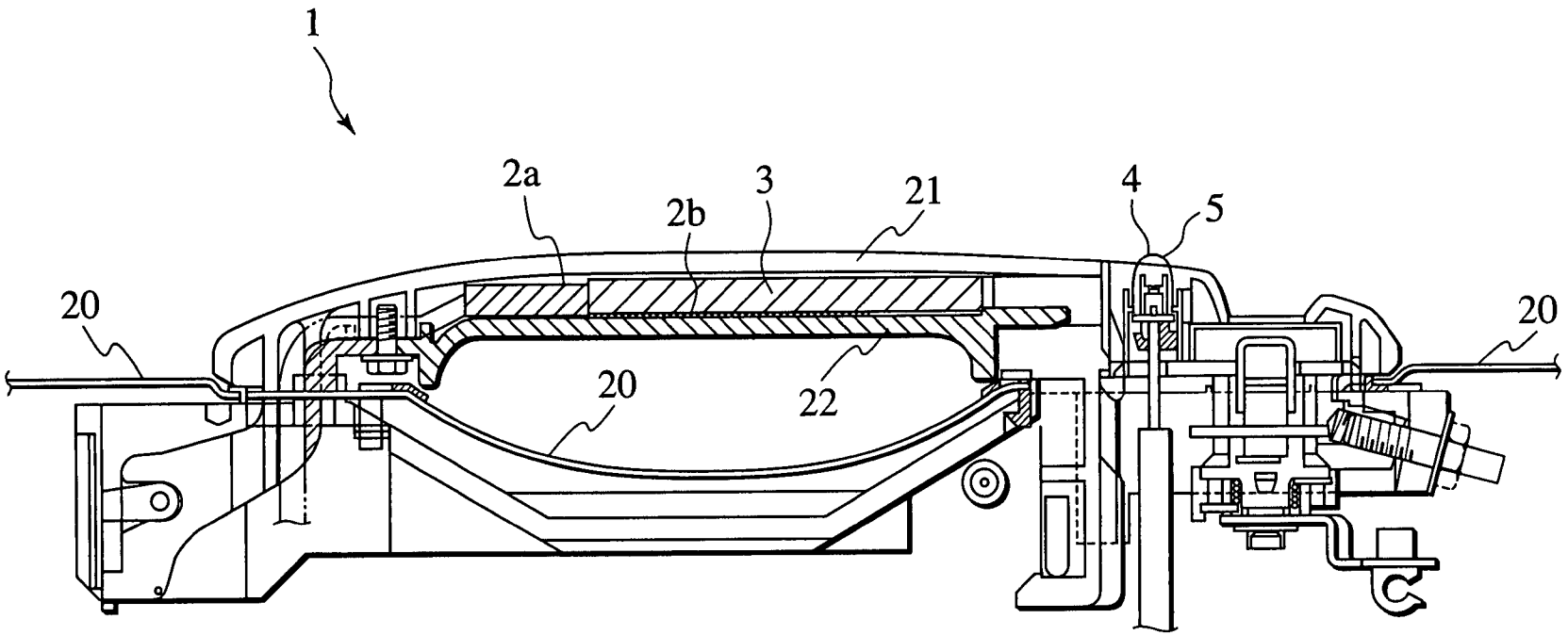
FIG. 2 is a sectional view of a door handle along a direction of the vehicle length.

As shown in FIG. 2, the touch sensor 2 comprises a sensor module including, for example, a capacitance type sensor body 2*a* and a sensor electrode 2*b*. The sensor body 2*a* and the sensor electrode 2*b* are housed in a hollow space provided between a handle grip 21 protruding from an outer plate of the door in a direction of the vehicle width and a handle case 22. The touch sensor 2 changes the capacitance when the user touches the door handle 1, and outputs a detection signal to the ECU 6 based on the change of the capacitance.

The antenna 3 is provided corresponding to the frequency of a request signal transmitted from the ECU 6 provided in the vehicle to the portable machine 7, and transmits the request signal from the ECU 6 to the portable machine 7, as shown in FIG. 1. As shown in FIG. 2, the antenna 3 is arranged in the hollow space provided between the handle grip 21 and the handle case 22.

The request switch 4 is a switch, which is operated at the time of locking or unlocking the door. When the request switch 4 is operated, a switch signal is transmitted to the ECU 6. As described above, when the portable machine 7 is received the request signal, the portable machine 7 transmits a response signal with the ID stored therein to the ECU 6.

The indicator 5 is a characteristic component of the present invention, and functions as a display for displaying the locking confirmable period. The indicator 5 comprises, for example, an LED, and is controlled based on a display signal transmitted from the ECU 6. The indicator 5 is arranged in the door handle 1 or in the vicinity of the door handle 1.

The indicator 5 lights up or flashes the LED as a display method of the locking confirmable period. Alternatively, the indicator 5 may use an LED for displaying multiple colors, to display the locking confirmable period or other conditions, for example, when the request switch 4 is operated at the time of unlocking, by changing the display color.

The indicator 5 may be provided singly as a display, or may be provided integrally with, for example, the request switch 4. In other words, an LED as the indicator 5 is built in the request switch 4, and the request switch 4 is formed of a switch constructed such that an operation section (not shown) of the request switch 4 emits light. The indicator 5 also having the function of the request switch 4 as described above is arranged, for example, in the vicinity of the door handle 1, as shown in FIG. 2.

As a result, the user who performs the locking confirmation action after locking the door can easily recognize the locking confirmable period by visual observation of the request switch 4 having the function of the indicator 5. Moreover, by sharing the request switch 4 and the indicator 5, miniaturization of the configuration can be achieved.

The ECU 6 controls the transfer of the request signal and the response signal communicated between the portable machine 7 and the ECU 6 at the time of locking or unlocking the door, to control the locking or unlocking of the door. The ECU 6 sets a locking confirmable flag indicating whether the door is in the locking confirmable state, after locking the door, activates a timer for measuring the locking confirmable period, and outputs a display signal for lighting up and displaying the indicator 5 to the indicator 5. The detection signal from the touch sensor 2 is ignored while the flag is set. After the timer has measured the locking confirmable period, for example, the time of for example several seconds and the locking confirmable period has passed, the ECU 6 suspends the output of the display signal to the indicator 5 to stop the measurement by the timer, and resets the locking confirmable flag. As a result, the indicator 5 is turned off, to finish the display of the locking confirmable period. Since the flag is reset, the detection signal from the touch sensor 2 is made effective.

The ECU 6 comprises a response signal receiving antenna 13 corresponding to the frequency of the response signal, and receives the response signal transmitted from the portable machine 7 via this antenna 13.

The ECU 6 controls a door lock motor 8 which locks or unlocks the door. The door lock motor 8 comprises an actuator motor (MTR) 9 for locking or unlocking the door at the driver's seat, an actuator motor (MTR) 10 for locking or unlocking the door at the passenger's seat, an actuator motor (MTR) 11 for locking or unlocking the doors at the backseats, and a door locked state detection switch 12 for detecting the locking or unlocking of the door, by detecting the position of the door locking and unlocking switch at a door knob.

Figure 3A:
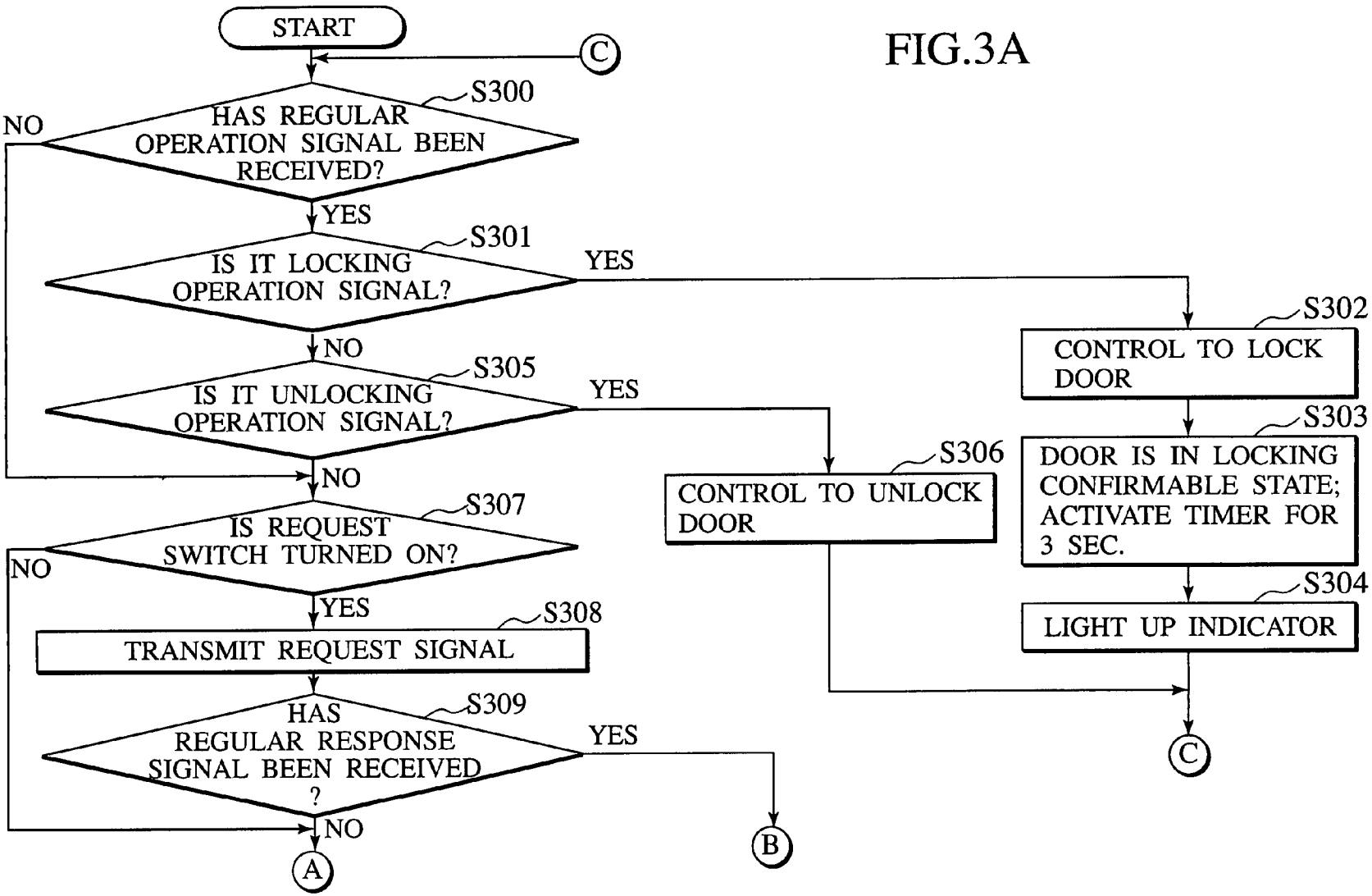

The locking and unlocking processing in the vehicle door locking and unlocking system will be described, with reference to FIGS. 3A and 3B illustrating the flowchart of the procedure in the locking and unlocking processing.

As shown in FIGS. 3A and 3B, it is judged whether a regular operation signal (response signal) transmitted from the portable machine 7 has been received by the system S via the antenna 13 (step 300). The regular operation signal stands for a signal in which the ID corresponding to the ECU 6 is included in the response signal transmitted from the portable machine 7, corresponding to the request signal transmitted from the antenna 3. When the regular operation signal is received by the ECU 6, it is judged whether the received regular operation signal is a locking operation signal (step 301).

When the received operation signal is the locking operation signal, the ECU 6 controls locking of the door (step 302), to lock the door. When the door is locked, the ECU 6 activates the timer, to measure the preset locking confirmable period, for example, three seconds (step 303). Moreover, the ECU 6 outputs a display signal to the indicator 5, in parallel with starting the measurement of the locking confirmable period. The indicator 5 is lighted up to display that the door handle 1 is in the locking confirmable state, corresponding to the display signal (step 304).

On the other hand, in the judgment result at step 301, when the received operation signal is not the locking operation signal, it is judged whether the received operation signal is an unlocking signal (step 305). When the received operation signal is an unlocking operation signal, the ECU 6 controls unlocking of the door, to unlock the door (step 306).

In the judgment result at step 305, when the received operation signal is not an unlocking operation signal, and in the judgment result at step 300, when the regular operation signal has not been received by the ECU 6, it is judged whether the request switch 4 is operated and in the ON state or not (step 307).

When the request switch 4 is operated and in the ON state, a request signal is transmitted from the ECU 6 to the portable machine 7 via the antenna 3 (step 308). Thereafter, the regular response signal is transmitted from the portable machine 7 to the ECU 6 corresponding to the request signal, and it is judged whether the ECU 6 has received the response signal (step 309).

When the ECU 6 has received the response signal, it is judged whether the door is in the locked state (step 310).

When the door is in the locked state, the ECU 6 controls unlocking of the door, to unlock the door (step 311). On the other hand, in the judgment result at step 310, when the door is not in the locked state, the ECU 6 controls locking of the door, to lock the door (step 312).

When the door is locked, the ECU 6 activates the timer, to measure the locking confirmable period, for example, three seconds (step 313). Moreover, the ECU 6 outputs a display signal to the indicator 5, in parallel with starting the measurement of the locking confirmable period. The indicator 5 is lighted up to display that the door handle is in the locking confirmable state, corresponding to the display signal (step 314).

On the other hand, in the judgment result at step 309, when the regular response signal has not been received by the ECU 6, and in the judgment result at step 307, when the request switch 4 is not switched on, it is judged whether the door is in the locked state (step 315).

When the door is not in the locked state, step 300 is executed, and when the door is in the locked state, it is judged whether the timer for measuring the locking confirmable period is activated, and the ECU 6 is measuring the locking confirmable period (step 316). When the timer in the ECU 6 is executing to measure the locking confirmable period, the indicator 5 is lighted up to display that the door is in the locking confirmable state (step 317).

On the other hand, in the judgment result at step 316, when the timer in the ECU 6 is not executing, the indicator 5 is turned off (step 318). After the indicator 5 is lighted up and measurement of the locking confirmable period has finished, in steps 304 and 314, the ECU 6 suspends the output of the display signal, and the indicator 5 is turned off through the loop of steps 300, 307, 315, 316, and 317. As a result, the user can recognize that the locking confirmable period has finished.

It is then judged whether the touch sensor 2 has detected the operation of the door handle 1 (step 319). When the operation is not detected, step 300 is executed. On the other hand, when the touch sensor 2 has detected the operation of the door handle 1, the ECU 6 transmits a request signal to the portable machine 7 (step 320).

Subsequently, a regular response signal is transmitted from the portable machine 7 to the ECU 6, and it is judged whether the ECU 6 has received the regular response signal (step 321). When the regular response signal is not transmitted from the portable machine 7 to the ECU 6, and the ECU 6 has not received the regular response signal, step 300 is executed.

On the other hand, in the judgment result at step 321, when the regular response signal is transmitted from the portable machine 7 to the ECU 6, and the ECU 6 has received the regular response signal, the ECU 6 controls locking of the door, to lock the door (step 322).

As described above, in the locking confirmable period after the door has been locked, the indicator 5 is lighted up to display that it is the locking confirmable period. As a result, the user can easily recognize the locking confirmable period by visual observation of the indicator 5. Therefore, after locking the door and while the indicator 5 is lighted up, the user can confirm locking by operating the door handle 1, without being anxious about unlocking of the door due to the locking confirmation operation by operating the door handle 1.

The present invention is not limited to the use for vehicles, but is also applicable to doors for houses. In the embodiment, the indicator is lighted up (or flashed) as a method of informing the locking confirmable period to the user, but other methods (e.g., voice announcement) may be used.

In the embodiment, the indicator 5 is mounted on the vehicle, but a display section may be provided in the portable machine instead of the indicator 5. In this case, the portable machine receives a signal indicating whether it is the locking confirmable period from the ECU, and a predetermined message is displayed on the display section on the portable machine corresponding to the signal.

What is claimed is:

1. A door locking and unlocking system for a vehicle door which is able to open/close by operation of a door handle, the system comprising:

a controller on a vehicle which is configured to transfer a predetermined frequency via an antenna provided in the vehicle to control locking and unlocking of the vehicle;

a portable machine which uses the same frequency as the predetermined frequency to transmit a door locking or unlocking signal to the controller; and a display controlled by the controller, wherein the controller, upon detecting a locked state of the vehicle door, activates the display that indicates for a predetermined time that the door handle is in a locking-confirmable mode, and while the display is activated, the controller prevents the door handle from unlocking the door.

2. A door locking and unlocking system according to claim 1, wherein the display is provided in the vehicle, and the display include a LED, the controller controls the LED being turned on during the locking confirmable period.

3. A door locking and unlocking system according to claim 1, wherein the display is provided in the vicinity of the door handle of the vehicle, and formed integrally with a request switch, which transmits a request signal for obtaining an ID of the portable machine to the portable machine.

4. A door locking and unlocking system according to claim 1, further comprising a sensor which detects whether the vehicle door is in the locked state/unlocked state, and transmits information relating to the state of the vehicle door to the controller.

* * * * *